US012655998B2

(12) United States Patent
Choi et al.

(10) Patent No.: US 12,655,998 B2
(45) Date of Patent: Jun. 16, 2026

(54) AIR CONDITIONER

(71) Applicant: LG ELECTRONICS INC., Seoul (KR)

(72) Inventors: Jae Bong Choi, Seoul (KR); Youngjun Lee, Seoul (KR); Dong Gun Gwoo, Seoul (KR); Hyeyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 344 days.

(21) Appl. No.: 18/276,469

(22) PCT Filed: Feb. 7, 2022

(86) PCT No.: PCT/KR2022/095021
§ 371 (c)(1),
(2) Date: Aug. 9, 2023

(87) PCT Pub. No.: WO2022/173279
PCT Pub. Date: Aug. 18, 2022

(65) Prior Publication Data

US 2024/0310064 A1 Sep. 19, 2024

(30) Foreign Application Priority Data

Feb. 10, 2021 (KR) ..... 10-2021-0019152

(51) Int. Cl.
*F24F 1/0355* (2019.01)

(52) U.S. Cl.
CPC ..... *F24F 1/0355* (2019.02)

(58) Field of Classification Search
CPC ..... F24F 2120/20; F24F 11/63
See application file for complete search history.

(56) References Cited

U.S. PATENT DOCUMENTS

2010/0158749 A1* 6/2010 Benedek ..... A61L 9/015 422/4
2016/0169851 A1 6/2016 Lee et al.
(Continued)

FOREIGN PATENT DOCUMENTS

JP 3389786 3/2003
KR 20050062039 A * 6/2005
(Continued)

OTHER PUBLICATIONS

International Search Report dated May 16, 2022 issued in Application No. PCT/KR2022/095021.

*Primary Examiner* — Steven B McAllister
*Assistant Examiner* — Michael James Giordano
(74) *Attorney, Agent, or Firm* — KED & ASSOCIATES

(57) ABSTRACT

The present invention pertains to an air conditioner, the air conditioner according to the present invention comprising: an air conditioner body comprising an air inlet and an air outlet: an input unit for inputting subjective environment information recognized by a user; at least one sensor unit that generates indoor environment information by detecting indoor environment; an environment control module that generates environment control information on the basis of at least one of the environment information input by the user and the indoor environment information; and a control unit that controls the deodorizing module one the basis of the environment control information. wherein the control unit determines an intensity of smell recognized by the user one the bases of the environment control information, controls a deodorizing module so that the deodorizing module operates in a first mode when the intensity of the smell recognized by the user is low, and when the intensity of the smell recognized by the user is high, controls the deodorizing module so that the deodorizing module operates in a second mode, and thus, the air conditioner has excellent effect of enabling
(Continued)

user-customized control, increasing the lifespan of a filter, and lowering power consumption.

7 Claims, 3 Drawing Sheets

(56) References Cited

U.S. PATENT DOCUMENTS

| | | | | |
|---|---|---|---|---|
| 2017/0334267 | A1 | 11/2017 | Jeong et al. | |
| 2020/0240669 | A1* | 7/2020 | Oshita | F24F 11/70 |

FOREIGN PATENT DOCUMENTS

| | | | | |
|---|---|---|---|---|
| KR | 10-0503506 | | 7/2005 | |
| KR | 10-2016-0071000 | | 6/2016 | |
| KR | 10-2020306 | | 9/2019 | |
| KR | 102020306 | B1 * | 9/2019 | G06N 3/04 |
| KR | 10-2020-0024993 | | 3/2020 | |
| KR | 10-2020-0074630 | | 6/2020 | |
| KR | 10-2020-0089045 | | 7/2020 | |

* cited by examiner

[FIG. 1]
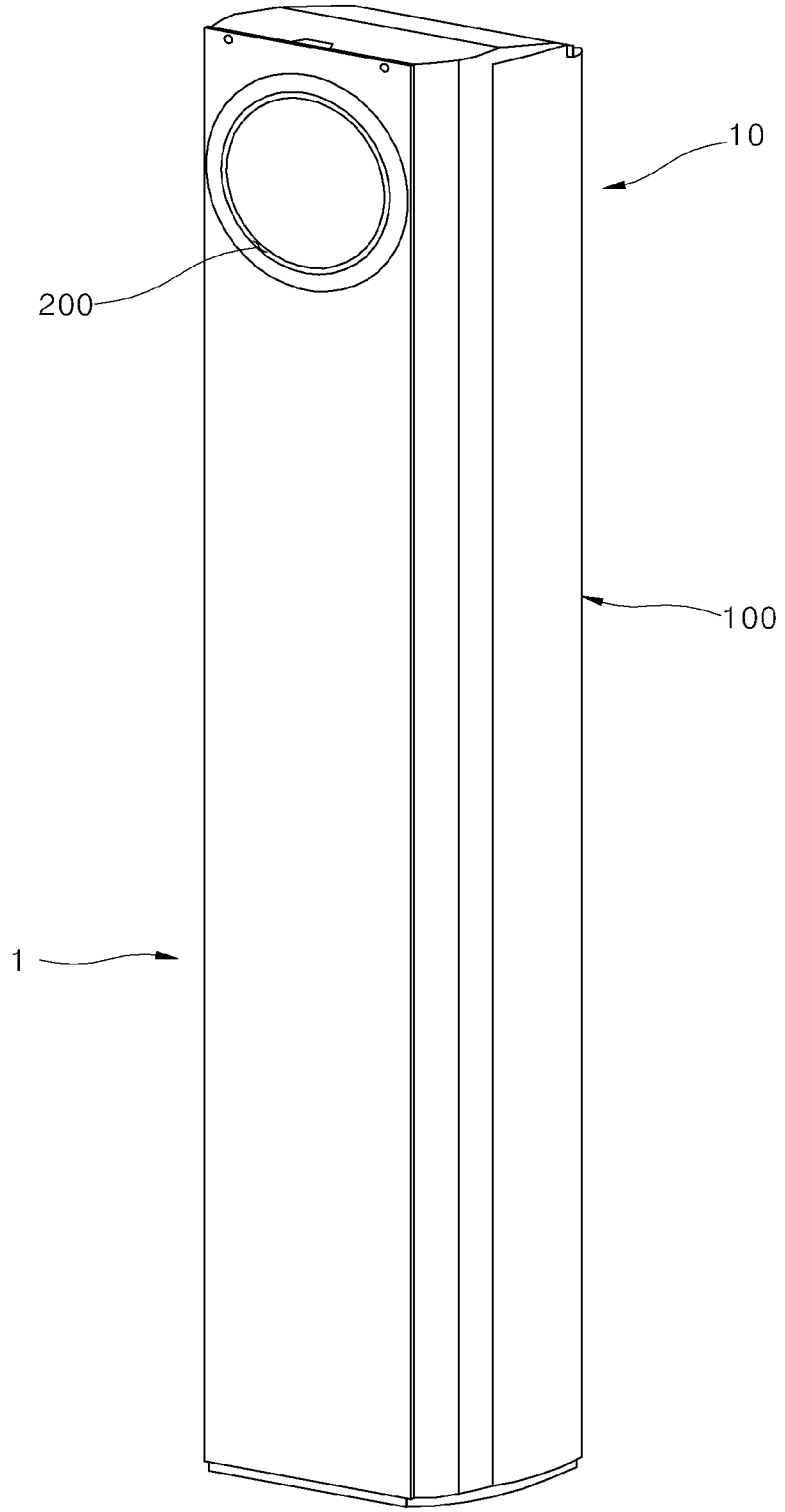

[FIG. 2]
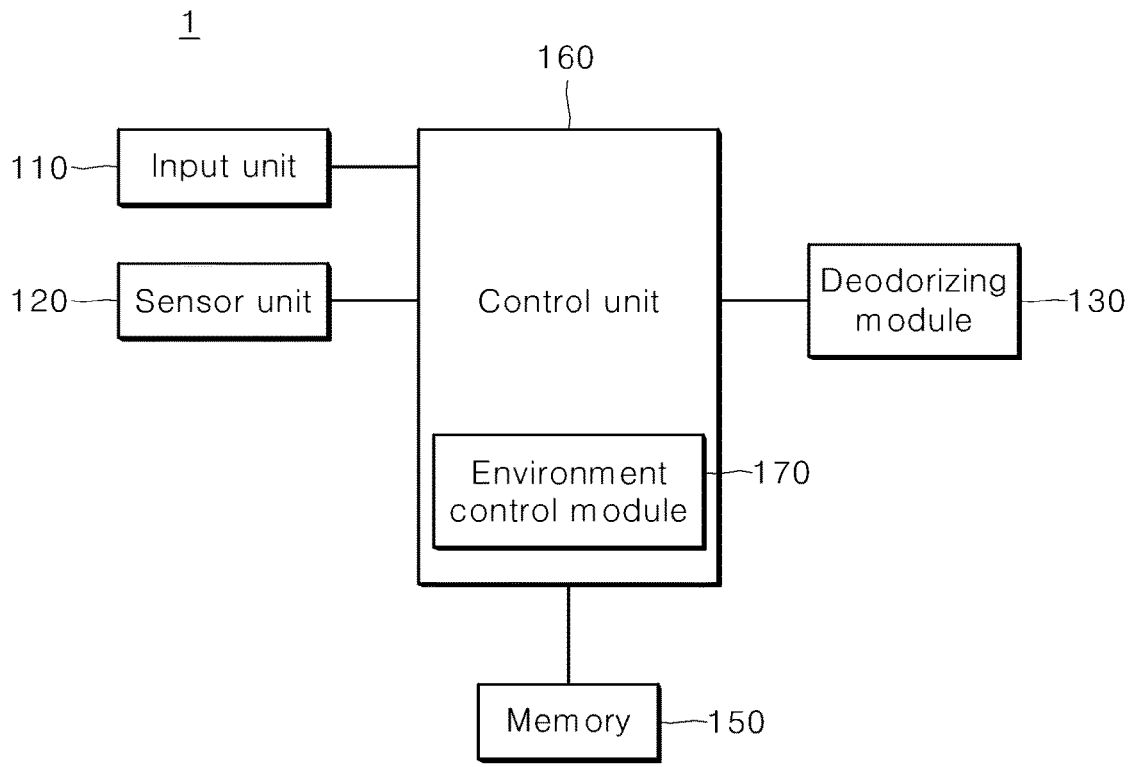
[FIG. 3]
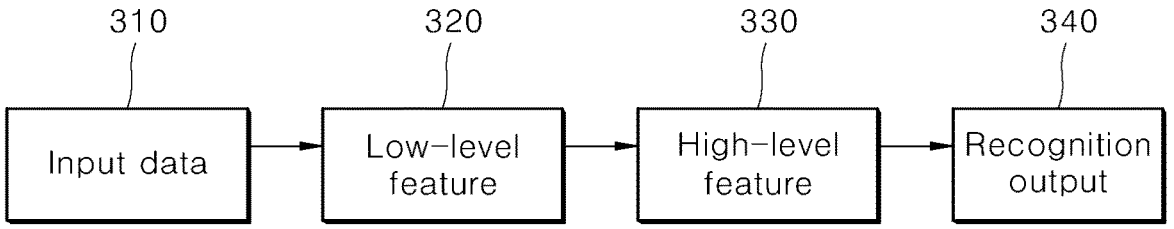

[FIG. 4]
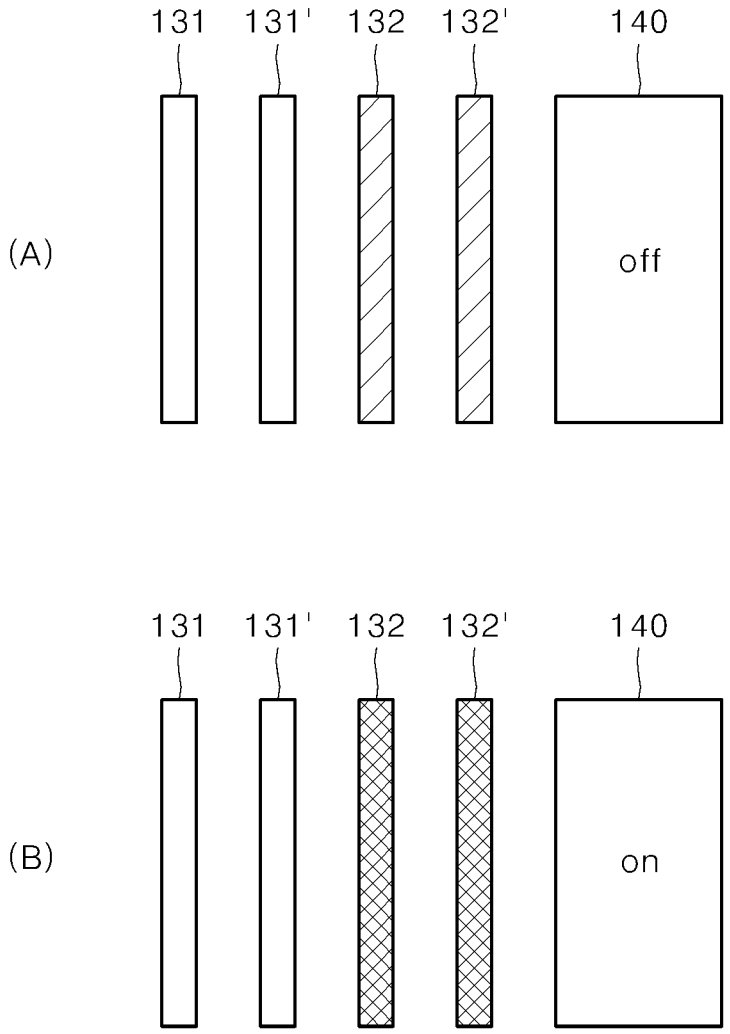

AIR CONDITIONER

CROSS-REFERENCE TO RELATED PATENT APPLICATIONS

This application is a U.S. National Stage Application under 35 U.S.C. § 371 of PCT Application No. PCT/KR2022/095021, filed Feb. 7, 2022, which claims priority to Korean Patent Application No. 10-2021-0019152, filed Feb. 10, 2021, whose entire disclosures are hereby incorporated by reference.

TECHNICAL FIELD

The present disclosure relates to an air conditioner that enables user-customized control, increases the lifespan of a filter and lowers power consumption.

BACKGROUND ART

Air conditioners are installed to provide a more comfortable indoor environment to users by discharging cold and hot air into a room to adjust the indoor temperature and to purify the indoor air in order to create a comfortable indoor environment. At this time, air purification may use a deodorizing device. The deodorizing device may have a combustion method, a deodorizing method using an oxidation catalyst and the like. Meanwhile, when using the combustion method as the deodorizing device, it is impossible to apply the combustion method to electric home appliances such as air conditioners because high temperatures are required. The deodorizing device using the oxidation catalyst also requires a high temperature of 200 or higher to decompose aldehydes, which are the cause of odor, and thus is not suitable for application to electric home appliances. Accordingly, a phocatalyst filter is applied to an air conditioner to purify air but there is a problem in that high power consumption is required and the filter replacement cycle is shortened to exhibit high decomposition power using the photocatalyst filter.

According to the prior art, in order to provide an optimal indoor environment while minimizing power consumption of an air conditioner, an automatic operation mode (such as a smart care and the like) automatically controlling the driving degree of a fan is provided to improve user convenience. However, since the automatic operation mode provided in conventional air conditioner is collectively provided without considering user characteristics, it is impossible to reflect the user characteristics and usage patterns. In particular, in case of odor, there is a difference in the type and intensity of chemical components of order felt by each person. Accordingly, the automatic driving mode provided in the prior has a problem in that it is difficult to satisfy all users.

PATENT DOCUMENT

Cited Document 1
Korean Publication Patent No. 10-2020-0089045

DESCRIPTION OF DISCLOSURE

Technical Problems

Accordingly, an objective of the present disclosure is to provide an air conditioner enables user-customized control.

Another objective of the present disclosure is to provide an air conditioner that may reduce power consumption while increasing the lifespan of a filter by recognizing a user-optimized setting environment and efficiently controlling the indoor environment.

Technical Solutions

To solve the above-noted and other problems, an air conditioner may include an air conditioner body comprising an air inlet and an air outlet: an input unit to which a user inputs subjective environment information recognized by the user; at least one sensor unit generating indoor environment information by detecting indoor environment; an environment control module generating environment control information based on at least one of the environment information input by the user and the indoor environment information; and a control unit controlling the deodorizing module based on the environment control information. The control unit may determine the intensity of smell recognized by the user based on the environment control information, control the deodorizing module to operate in a first mode when the intensity of the smell recognized by the user is low, and control the deodorizing module to operate in a second mode when the intensity of the smell recognized by the user is high.

In addition, the deodorizing module may include a first filter and a second filter, and the second filter may be a photocatalyst filter comprising a photocatalyst, and in the first mode, the second filter may be set to be deactivated and in the second mode, the second filter is set to be activated.

Advantageous Effect

The present disclosure may have following advantageous effects. The air conditioner according to the present disclosure may use the subjective environment information set by the user and the indoor environment information, and may learn through the machine learning, thereby quantifying the type and intensity of the user's personal smell, and controlling the air conditioner according to the type and intensity of the smell felt by the user.

In addition, the air conditioner according to the present disclosure may efficiently control the indoor environment by recognizing the user-optimized setting environment, thereby increasing the lifespan of the filter and decreasing power consumption by varying the mode of the deodorizing module based on the type and intensity of the smell felt by the user.

BRIEF DESCRIPTION OF DRAWINGS

FIG. 1 is a perspective view of an air conditioner according to an embodiment of the present disclosure;

FIG. 2 is a block view schematically showing key configuration of an air conditioner according to an embodiment of the present disclosure;

FIG. 3 is a view to describe deep learning as an example of artificial intelligence applied to a setting environment recognizer according to an embodiment of the present disclosure; and FIGS. 4 (A) and (B) are views schematically showing a first mode (A) and a second mode (B) of a deodorizing module according to an embodiment of the present disclosure.

DETAILED DESCRIPTION OF EXEMPLARY EMBODIMENT

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

Throughout the disclosure, each element may be singular or plural, unless stated to the contrary.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, an air conditioner according to embodiments of the present disclosure will be described in detail.

In an electric home appliance, a smart care for automatically controlling the driving of a fan is provided in order to reduce power consumption and user convenience. For example, the operating rate of a fan may be increased by determining the number of opening and closing times of a refrigerator door, the time of opening and closing of the refrigerator door and the like. Meanwhile, information based on the door opening/closing information described above has an ambiguous meaning. In addition, there is a subjective difference in the type and intensity of odor felt by each person, so it is difficult to provide satisfactory air purification to all users by collectively applying the conventional automatic operation mode provided to users.

The air conditioner is configured to provide users with a more comfortable indoor environment to users by purifying indoor air, and can be classified into ceiling-mounted type, wall-mounted type and stand type based on the installation location. FIG. 1 is a perspective view of an air conditioner 1 according to an embodiment of the present disclosure of the present disclosure, taking a stand-type air conditioner 1 as an example.

The air conditioner 1 according to the present disclosure may include an air conditioner body 10 including an air inlet 100 and an air outlet 200; an input unit 110 for inputting subjective environment information recognized by a user; at least one sensor unit 120 for creating indoor environment information by detecting indoor environment information; an environment control module 170 for creating environment control information based on at least one of the environment information input by the user and the above-noted indoor environment information; and a control unit 160 controlling the deodorizing module 130 based on the environment control information. The control unit 160 may determine the intensity of the smell recognized by the use based on the environment control information. When the intensity of the odor recognized by the user is low, the control unit 160 may control the deodorizing module 130 to operate in a first mode. When the intensity of the odor recognized by the user is high, the control unit 160 may control the deodorizing module 140 to operate in a second mode. Accordingly, it is possible to quantify the type and intensity of a user's personal odor by using not only the indoor environment information based on a preset value but also the environment information on the subjective odor recognized by the user and learning this through machine learning. Due to this, the user-optimized setting environment may be recognized and the indoor environment may be efficiently controlled accordingly. In addition, the mode of the deodorizing module 130 may be changed to increase the lifespan of the filter and reduce power consumption by using the quantified and visualized information as described above.

The air conditioner 1 according to the present disclosure may include the input unit 110 to which the user inputs the subjective environment information. At this time, the user input the type and intensity of the smell felt in the space through the input unit 110, to set the environment of the air conditioner 1. For example, the user may set the driving environment of the air conditioner 1 by selecting the intensity of air purification, fine dust, gas, etc. based on the smell felt by the user, thereby allowing the user to input the subjective recognition about the smell felt by himself or herself.

The input unit 110 may include at least one input means for inputting predetermined signals or data based on the user's manipulation. For example, the at least one input means may be realized as a mechanical button or a static electricity and static pressure type touch button. Or, the input unit 110 may include an interface connected with a remote control device. In other words, the input unit 110 may receive a control signal from the remote control device through the interface.

The air conditioner 1 may include at least one sensor unit 120 for creating the indoor environment information by detecting the indoor environment. The sensor unit 120 may include one or more sensors. For example, the sensor unit 120 may include a dust sensor for detecting the concentration of dust in the installation space and/or a gas sensor for detecting the presence and/or concentration of gas ((carbon monoxide, carbon dioxide, etc.) in the installation space.

At this time, the indoor environment information may include at least one of dust concentration, air cleanness and gas concentration.

The air conditioner 1 may include the environment control module 170 for creating environment control information based on at least one of the environment information manually input by the user and the indoor environment information.

The environment control module 170 may include a setting environment recognizer including a recognition model for recognizing a setting environment from the environment information input by the user and the indoor environment information; and an environment control information generation unit for creating the environment control information based on the recognition result. The setting environment recognizer may include a recognition model based on machine learning, which is a field of artificial intelligence. The setting environment recognizer may recognize the optical setting environment for the indoor space, in which the air conditioner 1 is installed, by inputting the environment information manually input by the user and the indoor environment information, which are received by the setting environment recognizer, to the recognition model. That is, since the setting environment recognizer according to an embodiment of the present disclosure may reflect the environment information manually input by the user, the optimal setting environment may be recognized by reflecting the subjective state felt by the user, rather than simply recognizing the setting environment based only on the indoor environment detected by the sensor unit 120.

The recognition model may include an artificial neural network ANN in the form of software or hardware. For example, the artificial neural network may include a deep neural network DNN such as a convolutional neural network CNN, a recurrent neural network RNN and a deep belief network DBN, which are learned through deep learning.

The setting environment recognizer may form a feature map by discovering correlations and patterns between the input information and data when the environment information input by the user and indoor environment information are input. For example, the setting environment recognizer may recognize an optimal setting environment by extracting low-level features and high-level features from input information and data. The correlations, patterns and features may be learned from a plurality of previously input information and data.

The environment control information generation unit may generate environment control information for controlling the indoor environment in response to the optimal setting environment recognized by the setting environment recognizer. For example, the environment control information may include a setting value for at least one of a plurality of operation modes preset in the air conditioner 1. According to embodiments, the environment control information may include information on specific control values of the deodorizing module 130.

According to an embodiment, when the recognition result of the setting environment recognizer is provided in the form of environment control information or the control unit 160 creates environment control information based the recognition result, the environment control information generation unit may not be provided separately.

FIG. 3 is a view to describe deep learning as an example of artificial intelligence applied to a setting environment recognizer according to an embodiment of the present disclosure. Artificial intelligence is a field of computer science and information technology that studies methods to enable computers to do thinking, learning and self-development that can be done with human intelligence. Machine learning, as one of these artificial intelligence research fields, may mean a system that makes predictions based on empirical data and improves its own performance through learning. Deep learning technology, which as a type of machine learning, learns by going down to a deep level in multiple stages based on data. Deep learning may represent a set of machine learning algorithms that extract core data from a plurality of data as the level increases. Referring to FIG. 3, a computing machine may form a feature map by discovering a certain pattern from input data. For example, a computing machine may extract a low-level feature and a high-level feature, recognize a target and output the result.

The environment control module 170 may update the recognition model of the setting environment recognizer based on the environment information input by the user, the indoor environment information and the recognition result.

Meanwhile, data for learning the artificial neural network may be stored in a memory 150. According to an embodiment, weights and biases, which constitute an artificial neural network structure, may be stored in the memory 150. Or, according to an embodiment, weights and biases, which constitute the artificial neural network, may be stored in an embedded memory of the environment control module 170.

Meanwhile, the environment control module 170 may perform a learning process of the setting environment recognizer by using the acquired information and data and the recognition result, whenever the optimal setting environment is recognized by acquiring the environment information input by the user, the indoor environment information. As the learning process is performed, the artificial neural network structure such as weights may be updated.

The air conditioner 1 may transmit the acquired environment information input by the user, the indoor environment information and the recognition results to the server, and may receive data related to machine learning from the server. In this instance, the server may include a learning module and perform a learning process by using the environment information input by the user, the indoor environment information and the recognition results, which are received from the air conditioner 1. The air conditioner 1 may update the setting environment recognizer of the environment control module 170 based on data related to machine learning received from the server.

The air conditioner 1 may include the control unit. The control unit 160 may control an overall operation of the air conditioner 1. The controller 160 may control components to perform cooling, heating, dehumidification, and/or air cleaning operations based on a set temperature, a set humidity, a selected operation mode and the like. The controller 160 may perform the various operations based on a preset algorithm.

The controller 160 according to an embodiment may input the environment information input by the user and the indoor environment information acquired through the sensor unit 120 to the artificial intelligence-based environment control module 170, and then acquire environment control information for the installation space of the air conditioner 1. The control unit 160 may control the deodorizing module 130 based on the acquired environment control information.

The control unit 160 may determine the intensity of odor recognized by the user based on the environment control information. When the intensity of odor recognized by the user is low, the control unit 160 controls the deodorizing module 130 to operate in a first mode. When the intensity of small recognized by the user is strong, the control unit 160 controls the deodorizing module 130 to operate in a second mode. At this time, the intensity may mean the intensity in a board sense including the type of odor as well as the intensity in a narrow sense indicating a strong degree of odor.

As described above, depending on the type and intensity of the odor that the user needs to purity the air, the deodorizing module 130 may be controlled according to the degree of air purification required by the user, so the lifespan of the filter provided in the deodorizing module 130 can be increased, thereby easily increasing the replacement cycle, facilitating management and reducing power consumption.

Conventionally, the air conditioner may include a filter for air purification. Filters require periodic maintenance and frequent replacement to prevent the propagation of mold and the like caused by moisture along with the removal indoor dust.

The deodorizing module 130 of the air conditioner 1 may be a combined deodorizing module. For example, it may be a combined deodorizing module including one or more of a pre-filter, a dust collecting filter and a photocatalyst filter.

The deodorizing module 130 of the air conditioner 1 may include a first filter 131 and 131' such as a pre-filter for filtering out large dust in the air flowing into an inlet of the air conditioner 1 and/or a dust filter for filtering air through collecting air particles ionized by an ionization unit. The first filter 131 and 131' may mean a deodorizing filter not including a photocatalyst.

Together with the first filter 131 and 131', a photocatalyst filter including a photocatalyst may be provided as a second filter 132 and 132' to increase light efficiency. The photocatalyst filter may be a combined deodorizing module including one filter to which different photocatalyst materials are attached or a plurality of filters to which different photocatalyst materials are attached, respectively. In this case, the photocatalyst material may include a metal, a metal oxide or a metal oxide on which a metal is supported, and different photocatalystic activities may be exhibited by varying types of metals.

FIG. 4 (A) schematically shows that the deodorizing module 130 is in a first mode and FIG. 4 (B) shows that the deodorizing module 130 is in a second mode. As shown in FIG. 4, the deodorizing module 130 may include two first filters 131, 131' and two second filters 132 and 132', but the present disclosure is not limited thereto. In FIG. 4, the first filters 131 and 131' and the second filters 132 and 132' are sequentially disposed. However, the present disclosure is not limited thereto and the first filters 131 and 131' and the second filters 132 and 132' may be alternately disposed.

The photocatalyst filter may include a plasma unit that forms a plasma region to generate OH radicals and ozone. The plasma unit may operate to generate a plasma discharge, so that air can be oxidized or decomposed. The photocatalyst filter may include a photocatalyst reacting with the ozone generated in the plasma unit, and the photocatalyst can reduce the amount of ozone.

The photocatalyst filter may include a light source 140. For example, the light source 140 may includes an ultraviolet light source 140 emitting ultraviolet light. The ultraviolet light source 140 may be realized as UV-LED. For example, the UV-LED may emit ultraviolet light having at least one of UV-A with a wavelength of about 315 micrometers to about 400 micrometers, UB-B with a wavelength of about 280 micrometers to about 315 micrometers, and UV-C with a wavelength of about 200 micrometers to about 280 micrometers. The UV irradiation may also impart a sterilization function. Or, the light source 140 may include a visible light source 140 emitting visible light. For example, the visible light source 140 may emit blue light with the strongest energy among visible light rays having a wavelength of about 380 micrometers to about 500 micrometers. The light source 140 may vary depending on the photocatalyst material.

The photocatalyst filter may activate the photocatalyst, using light irradiated by the light source 140 to decompose harmful substances, contaminants, odor particles and the like. Specifically, the catalyst may have electrons and holes, which are generated from energy obtained by absorbing light irradiated by light, generate peroxide anions or hydroxy radicals, etc., and they depose and remove harmful substances and the like, thereby performing air cleanness, deodorizing or antibacterial action. Meanwhile, to exhibit high decomposition activity by using the photocatalyst filter, there is a problem in that high power consumption is required and a filter replacement cycle is shortened.

Accordingly, the air conditioner 1 may determine the intensity of the odor recognized by the user based on the environment control information, and may control the mode of the deodorizing module 130 based on the determined information, so that the air conditioner 1 may increase the lifespan of the filter and minimize power consumption.

As shown in FIG. 4, when the intensity of the odor recognized by the user is low (see FIG. 4, (A)), the control unit 160 may control the deodorizing module 130 to operate in a first mode in which the second filters 132 and 132' which are photocatalyst filters are not activated. For example, the second filters 132 and 132' may be deactivated by turning off the power of the light source 140.

When the intensity of the odor recognized by the user is high (see FIG. 4, (B)), the control unit 160 may control the deodorizing module 130 to operate a second mode in which the second filters 132 and 132', which are photocatalyst filters, are activated. For example, the second filters 132 and 132' may be activated by turning on the power of the light source 140.

The first filters 131 and 131' may not include separate catalyst. Accordingly, regardless of whether the deodorizing module 130 is controlled in the first mode or the second mode, a basic deodorizing function may always be performed when the air conditioner 1 is operated.

The photocatalyst filter may remove different materials, depending on the photocatalyst provided therein, which may be utilized to increase the lifespan of the photocatalyst filter and minimize power consumption. For example, carbon monoxide may be removed through an oxidation reaction, and nitrogen oxides may be removed through a reduction reaction. Accordingly, when the user strongly reacts to carbon monoxide, the photocatalyst filter including platinum Pt or palladium Pd, which is a novel metal of a catalyst for the oxidation reaction, may be controlled to be activated. When the user strongly reacts to nitrogen oxide, the photocatalyst filter containing rhodium Rh, which is a noble metal of the reduction reaction catalyst, may be controlled to be activated. Alternatively, by using a filter having a corrugated structure as the photocatalyst filter, several compartments having different photocatalyst materials, respectively, may be provided in one filter. In this way, other compartments may be activated based on the intensity and type of the odor recognized by the user by providing the second filters 132 and 132' having the corrugated structure. Accordingly, the lifespan of the filters may be increased.

The first mode and the second mode may be divided based on the type of the photocatalyst filter of the composite deodorizing module. For example, when the user strongly reacts to nitrogen oxides, the activation of the photocatalyst filter for removing nitrogen oxides may be controlled as the second mode, and the case, where the photocatalyst filter needs not be activated, may be controlled as the first mode.

The deodorizing module may include a plasma unit to exhibit strong sterilization and deodorization function. The plasma may be formed by adjusting voltages and currents. Due to this structure, the voltage and/or current of the second mode may be controlled to be higher than that of the first mode.

The deodorizing module may exhibit stronger air purification as the operation time is longer. Due to this structure, the operation time of the second mode may be controlled to be longer than that of the first mode.

The control unit 160 may control the deodorizing module 130 to operate in the first mode after the deodorizing module 130 operates in the second mode for a preset target time. Accordingly, power consumption may be decreased while the lifespan of the filter is increased. For example, the preset target time may be determined based on a concentration at a point in time when the user thinks the air pollution or smell has been removed by learning the environment information input by the user and the indoor environment information.

The control unit 160 may transmit at least one of the environment information input the user and the indoor environment information, and the recognition result to a learning server. The environment control module 170 may receive updated learning data from the learning server, and may update the recognition model of the setting environment recognizer based on the received learning data. Accordingly, the user may be provided with the optimized air conditioner 1.

The air conditioner 1 may include a memory 150. In the memory 150, control data for controlling the operation of the air conditioner 1, sensing data sensed or measured through the sensor unit 120, data transmitted and received after manually input by the user may be stored. In addition, data for learning the artificial neural network may be stored in the memory 150. According to an embodiment, weights and biases constituting the artificial neural network structure may be stored in the memory 150. Alternatively, according to an embodiment, weights and biases constituting the artificial neural network structure may be stored in an embedded memory of the environment control module 170.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

DESCRIPTION OF REFERENCE NUMERALS

1: Air conditioner
10: Body
100: Air inlet
200: Air outlet
110: Input unit
120: Sensor unit
130: Deodorizing module
131, 131': First filter
132, 132": Second filter
140: Light source
150: Memory
160: Control unit
170: Environment control module

What is claimed is:

1. An air conditioner, comprising:

an air conditioner body comprising an air inlet and an air outlet;

an input unit configured to receive subjective environment information recognized and input by a user, the subjective environment information including a type of smell and a user desired intensity of air purification;

at least one sensor that generates indoor environment information by detecting indoor environment;

an environment control module that generates environment control information using the environment information input by the user and the indoor environment information;

a deodorizing module configured to purify air flowing through the air conditioner body; and a control unit that controls the deodorizing module based on the environment control information, wherein the control unit determines an intensity of smell recognized by the user based on the environment control information, controls the deodorizing module to operate in a first mode when the intensity of the smell recognized by the user is low, and controls the deodorizing module to operate in a second mode when the intensity of the smell recognized by the user is high, wherein the deodorizing module comprises:

a plurality of first filters, the plurality of first filters including a pre-filter and a dust collecting filter;

a plurality of second filters, wherein the plurality of second filters is each a photocatalyst filter comprising at least one different photocatalyst; and a light source, and wherein in the first mode, the plurality of second filters is deactivated by turning off the light source, and in the second mode, the light source is turned on and the plurality of second filters is selectively activated.

2. The air conditioner of claim 1, wherein the control unit controls the deodorizing module to operate in the first mode after operating in the second mode for a preset target time period.

3. The air conditioner of claim 1, wherein the environment control module comprises:

a setting environment recognizer comprising a recognition model recognizing a setting environment from the environment input by the user and the indoor environment information; and an environment control information generation unit that generates the environment control information based on the recognition result.

4. The air conditioner of claim 3, wherein the environment control module updates the recognition model of the setting environment recognizer based on the environment information input by the user, the indoor environment information, and the recognition result.

5. The air conditioner of claim 1, wherein the indoor environment information comprises at least one of dust concentration, air cleanliness, or gas concentration.

6. The air conditioner of claim 1, wherein the sensor comprises at least one of a dust sensor or a gas sensor.

7. The air conditioner of claim 3, wherein the control unit transmits at least one of the environment information input by the user and the indoor environment information or the recognition result to a learning server, the environment control module receives updated learning data from the learning server, and updates the recognition model of the setting environment recognizer based on the received learning data.

* * * * *